United States Patent [19]

Futami et al.

[11] 4,266,290

[45] May 5, 1981

[54] ELECTRONIC WRISTWATCH CONTROL MECHANISM

[75] Inventors: Yoshinori Futami; Tomio Ota, both of Suwa, Japan

[73] Assignee: Kabushiki Kaisha Suwa Seikosha, Tokyo, Japan

[21] Appl. No.: 926,165

[22] Filed: Jul. 19, 1978

[30] Foreign Application Priority Data

Jul. 19, 1977 [JP] Japan ..... 52/86288

[51] Int. Cl.[3] ..... G04B 19/00

[52] U.S. Cl. ..... 368/76; 368/80; 368/184; 368/185; 368/187

[58] Field of Search ..... 328/49; 58/23 R, 23 BA, 58/85.5; 73/6; 368/80, 76, 184, 185, 187, 47

[56] References Cited

U.S. PATENT DOCUMENTS

| | | | |
|---|---|---|---|
| 3,800,233 | 3/1979 | Sauthier | 328/49 |
| 3,901,022 | 8/1975 | Cleusix et al. | 58/23 R X |
| 3,945,194 | 3/1976 | Gollinger | 58/23 R |
| 3,975,897 | 8/1976 | Naito | 58/85.5 X |
| 3,998,044 | 12/1976 | Yamauchi et al. | 58/23 R |
| 4,044,543 | 8/1977 | Ikehata et al. | 58/85.5 X |

*Primary Examiner*—Ulysses Weldon

*Attorney, Agent, or Firm*—Blum, Kaplan, Friedman, Silberman & Beran

[57] ABSTRACT

A manually operated control mechanism for permitting a high frequency detection signal to be selectively produced is provided. A selection circuit is coupled to a divider circuit for receiving therefrom a low frequency timekeeping signal and a higher frequency detection signal. The selection circuit is normally disposed in a first mode and transmits the low frequency timekeeping signal applied thereto and is adapted to be disposed into a second mode to thereby transmit the higher frequency detection signal applied thereto. A manually operative member is adapted to be coordinately displaced between a first non-engaging position and a second position wherein the manually operative member engages said selection circuit to thereby dispose same in a second mode in order to effect the transmission thereby of the higher frequency detection signal.

7 Claims, 7 Drawing Figures

ELECTRONIC WRISTWATCH CONTROL MECHANISM

BACKGROUND OF THE INVENTION

This invention is directed to a manual control mechanism for an electronic wristwatch, and, in particular, to a manual control mechanism that permits a plurality of signals produced by the timekeeping circuitry of an electronic wristwatch to be selectively utilized for a particular purpose such as keeping time or detecting the rate of timekeeping being performed thereby.

One approach that has been adopted for substantially reducing the current consumption of analog display electronic wristwatches is the elimination of the second hand. Specifically, in analog display electronic wristwatches, the clock hands are incrementally advanced in response to the incremental rotation of a step motor. Accordingly, if the second hand is eliminated, the time period of the low frequency timekeeping signal applied to the step motor can be increased considerably, thereby reducing the amount of current required to drive the step motor. For example, the step motor of an electronic wristwatch that is devoid of a second hand can be driven by a low frequency timekeeping signal having a period of ten seconds or more.

Although the increase in the period of the low frequency timekeeping signal considerably reduces the current consumption of the electronic wristwatch and, hence, increases the life of the battery utilized to energize same, timing rate detection is clearly rendered more difficult as a result thereof. Specifically, in order to adjust the timekeeping circuitry of an electronic wristwatch, rate detection circuitry is utilized to detect the timing rate of the timekeeping circuit. It is noted, however, that if the period of the low frequency timekeeping signal is on the order of ten seconds or more, the time required for the detection circuit to accurately determine the timing rate of the timepiece is also considerably increased. Alternatively, if the time for servicing the wristwatch is not considerably increased, the accuracy with which the timing rate is corrected is considerably lessened. Accordingly, an electronic wristwatch control mechanism that eliminates the disadvantages noted above of providing a low frequency timekeeping signal having a period of more than one second is provided by the instant invention.

SUMMARY OF THE INVENTION

Generally speaking, in accordance with the instant invention, a manually operated control mechanism for selectively obtaining a detection signal from the timekeeping circuit is provided. The timekeeping circuit is comprised of an oscillator circuit for producing a high frequency time standard signal and a divider circuit for producing a low frequency timekeeping signal. The divider circuit includes a plurality of series-connected divider stages and, in addition to producing the low frequency timekeeping signal, also produces an intermediate frequency detection signal. A selection assembly having a selector circuit and a selecting member are coupled to the divider circuit. The selector circuit is normally disposed in a first mode and effects a transmission of the low frequency timekeeping signal produced by the divider circuit. The selector circuit is adapted to be selectively disposed into a second mode and thereby transmit the intermediate frequency detection signal produced by the divider circuit. A manually operative member is normally disposed in a first non-engaged position and is adapted to be manually displaced into a second engaged position with said selecting mechanism to thereby dispose the selector circuit into a second mode so that the intermediate frequency signal is transmitted thereby.

Accordingly, it is an object of the instant invention to provide an improved manually operated control mechanism for an electronic wristwatch.

Another object of the instant invention is to provide an improved manually operated control mechanism for an analog display electronic wristwatch.

Still a further object of the instant invention is to provide an analog display electronic wristwatch wherein current consumption is reduced during normal timekeeping operation and highly accurate detection of the timing rate can be effected.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
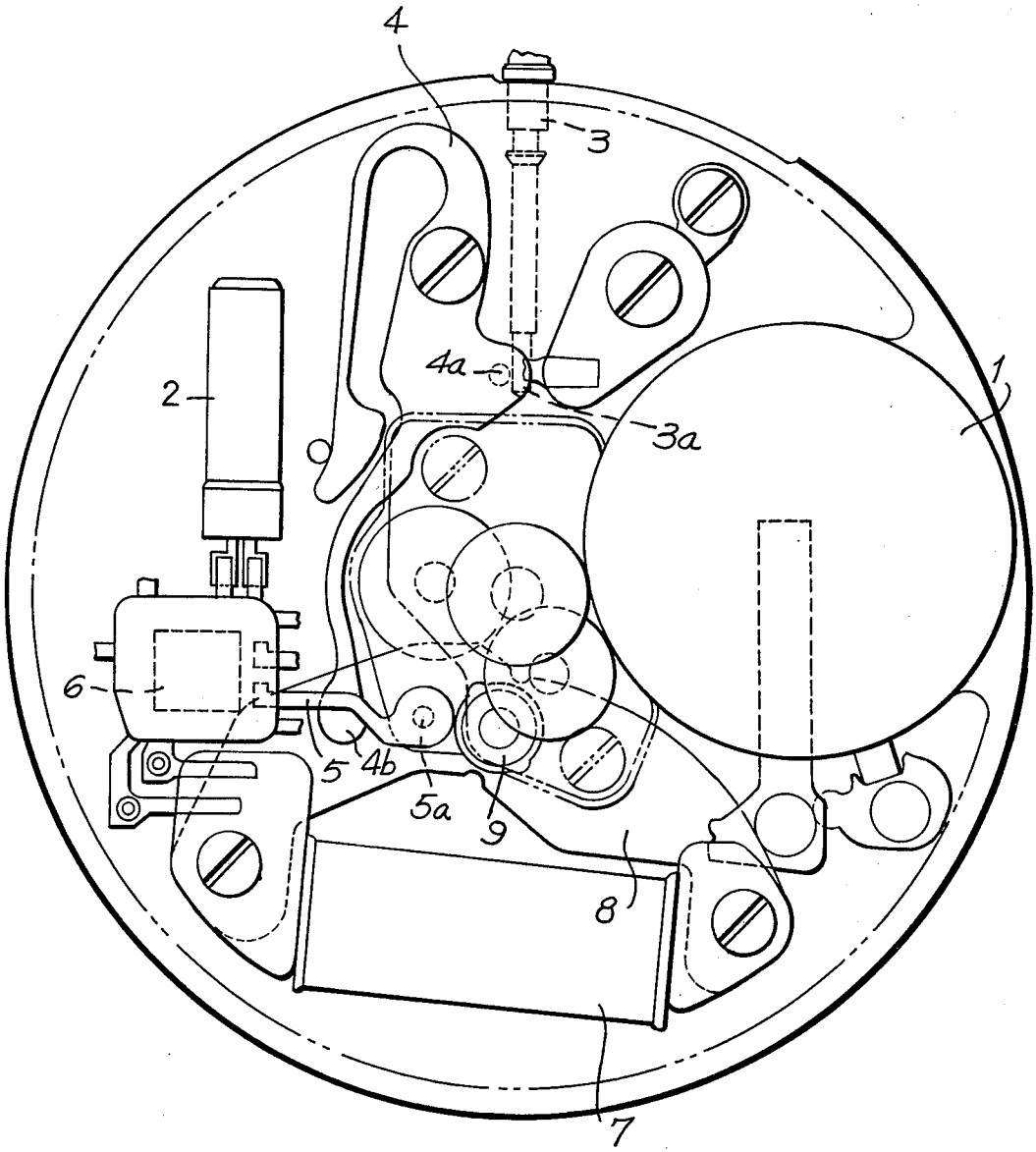
FIG. 1 is a plan view of an analog display electronic wristwatch constructed in accordance with a preferred embodiment of the instant invention.
Figure 2:
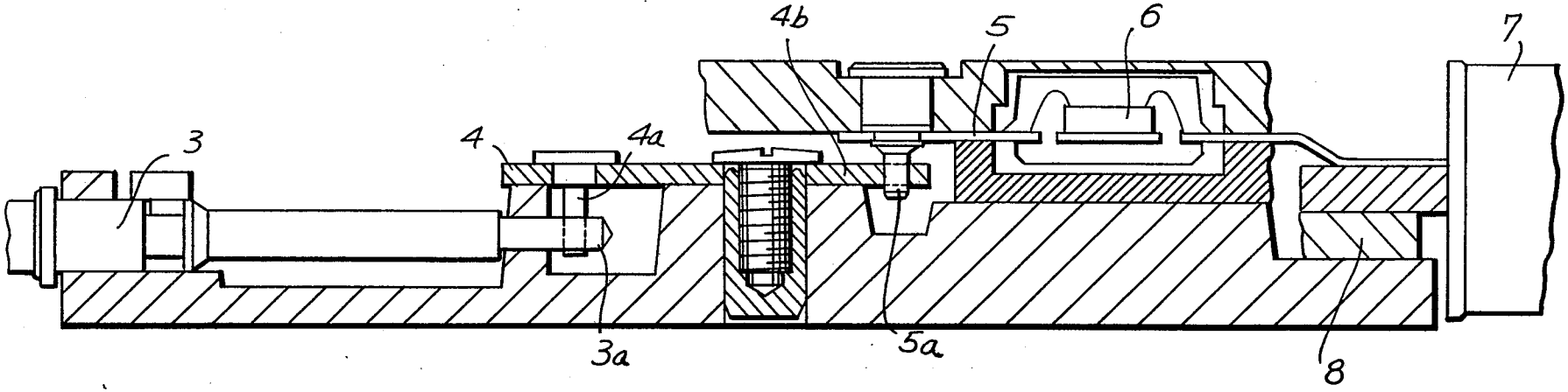
FIG. 2 is a sectional view, taken in elevation, of the electronic wristwatch depicted in FIG. 1.
Figure 6:
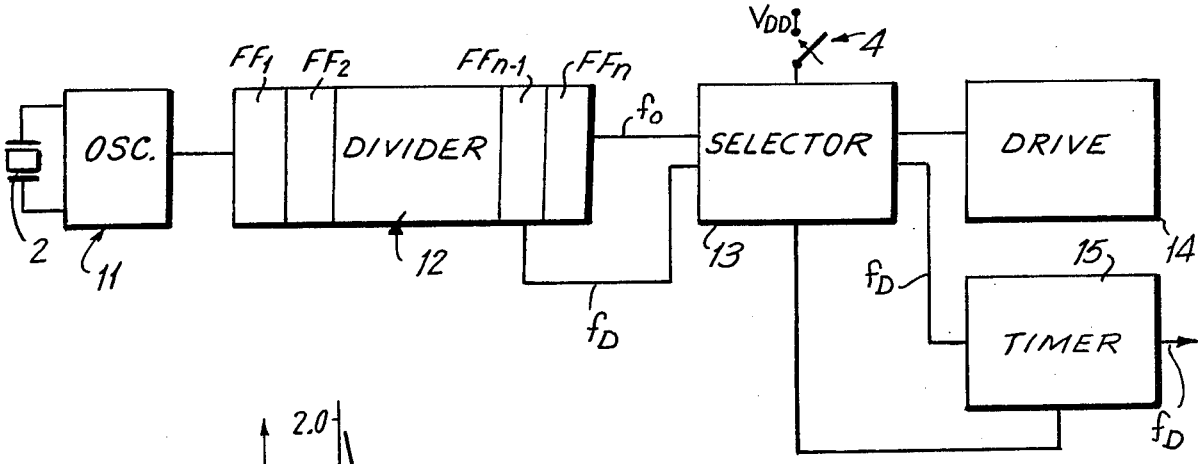
FIG. 6 is a block circuit diagram of an electronic timekeeping circuit constructed in accordance with a preferred embodiment of the instant invention.

Reference is first made to FIGS. 1, 2 and 6, wherein an electronic wristwatch, constructed in accordance with a preferred embodiment of the instant invention, is depicted. A DC battery 1 is electrically coupled to an electronic circuit chip 6, which circuit chip incorporates the entire electronic timekeeping circuit of the wristwatch. Coupled to the circuit chip 6 is a quartz crystal vibrator 2, which vibrator is capable of vibrating at a frequency of $2^{16}$ Hz and, as is illustrated in FIG. 6, is coupled to an oscillator circuit 11.

The oscillator circuit 11, in response to the high frequency vibration of the vibrator 2, applies a high frequency signal having a frequency on the order of $2^{16}$ Hz to a divider circuit 12. Divider circuit 12 is comprised of a plurality of series-connected divider stages $FF_1$, $FF_2$ through $FF_n$. The last divider stage $FF_n$ produces a low frequency timekeeping signal $f_0$, which signal is applied through a selector circuit 13 to an electromechanical transducer drive circuit 14. Additionally, one of the intermediate divider stages produces an intermediate frequency detection signal $f_D$, which signal has a higher frequency than the low frequency timekeeping signal $f_0$ and is applied to the selector circuit 13. When a selecting spring 4 (diagrammatically illustrated as a switch in FIG. 6) is disposed in a closed position, the selector circuit 13 is disposed in a second mode so that the intermediate frequency detection signal $f_D$ is transmitted therethrough. Alternatively, when the selecting spring is normally disposed in an open position, the selector circuit is disposed in a first mode so that the low frequency timekeeping signal $f_0$ is transmitted therethrough.

Once again, referring to FIGS. 1 and 2, a mutually displaceable operative member 3 extends out of the watch case in order to permit same to be manually displaced in a direction along the axial extent thereof. Operative member 3 includes an engaging portion 3*a*, which engaging portion is adapted to engage a stopper pin 4*a* projecting from a selecting spring 4, which spring is secured to the watch plate. Selecting spring 4 is formed from resilient conductive material and, as illustrated in FIG. 1, in response to the stop pin 4*a* being engaged by manually operative member 3, a moving contact portion 4*b* thereof is displaced out of engagement with a contact pin 5*a*. Contact pin 5*a* is coupled to lead 5, which lead is coupled to the input of the timekeeping circuit integrated into circuit chip 6. The integrated circuit chip 6 is also coupled to a step motor coil 7. Step motor coil 7 is wrapped around a stator pole 8, which stator pole 8 surrounds a rotor 9 in order to effect stepping of same in a conventional manner.

As aforenoted, the manually operative member 3 is adapted to be displaced into at least two positions. When the operative member 3 is positioned in the manner illustrated in FIG. 1, the tip portion thereof engages the stopper pin 4*a* of the selecting spring 4 to thereby displace the moving contact portion 4*b* thereof out of contact with the contact pin 5*a*. However, if manually displaceable operative member 3 is pulled out, the pin portion thereof will disengage from the stopper pin 4*a*, and thereby permit the selecting spring 4 to rotate the moving contact portion 4*b* into engagement with the contact pin 5*a*. By coupling the selecting spring 4 to one terminal of the power supply, the selecting spring operates as a switch for selectively disposing the selection circuit from a first mode to a second mode.

With reference to FIG. 6, when the moving contact 4*b* is out of engagement with contact pin 5*a*, the circuit is maintained in an open or first mode whereby the low frequency timekeeping signal $f_0$ is transmitted through the selector circuit 13 to a suitable drive circuit for effecting a driving of the electronic timepiece. Alternatively, if the moving contact portion 4*b* of switching spring 4 is rotated into engagement with contact pin 5*a*, the selector circuit is disposed in a closed or second mode. When the selector circuit is disposed in a second mode, the intermediate frequency detection signal $f_D$ is transmitted through the selector circuit thereby permitting the rate of the timekeeping circuit to be determined. If the second hand is removed, the period of the low frequency timekeeping signal can be selected to fall within a range of ten seconds to one minute. At the same time, the intermediate frequency detection signal can be selected to have a frequency that is considerably higher than the low frequency timekeeping signal in order to permit the timing rate to be detected as quickly as possible.

Figure 3B:
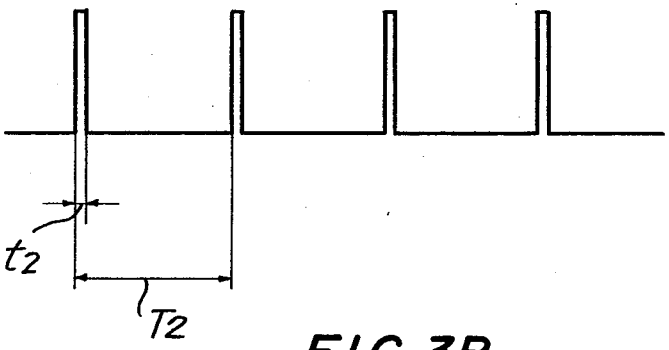
FIG. 3B is a wave diagram illustrating the intermediate frequency detection signal produced by the timekeeping circuit depicted in FIG. 6.
Figure 3A:
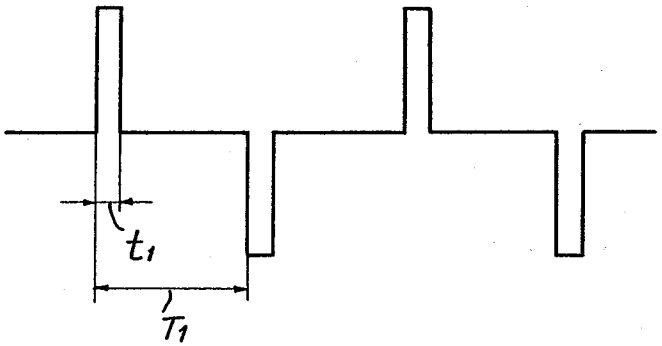
FIG. 3A is a wave diagram produced in response to the low frequency timekeeping signal produced by the timekeeping circuit illustrated in FIG. 6.

The signal applied to the step motor by the drive circuit 14, in response to the low frequency timekeeping signal $f_0$ applied thereto, is illustrated in FIG. 3A. The alternating pulses are produced in response to a low frequency signal having a period $T_1$ on the order of ten seconds to one minute. As is detailed below, by selecting the pulse width or duty cycle of the signal produced by the drive circuit to have a period $t_1$, sufficient to drive the step motor, the AC drive pulse will sufficiently reduce the current consumption of the wristwatch.

The intermediate frequency detection signal produced by the divider circuit is illustrated in FIG. 3B. The intermediate frequency detection signal is provided with a period $T_2$ and a pulse width or duty cycle $t_2$. Accordingly, if the period $T_2$ is selected to be considerably shorter than the period $T_1$, such as on the order of 1 or 2 ms, the intermediate frequency detection signal $f_D$ can be applied to a conventional detection circuit in order to produce a reading representative of the timing rate of the divider circuit.

Figure 4:
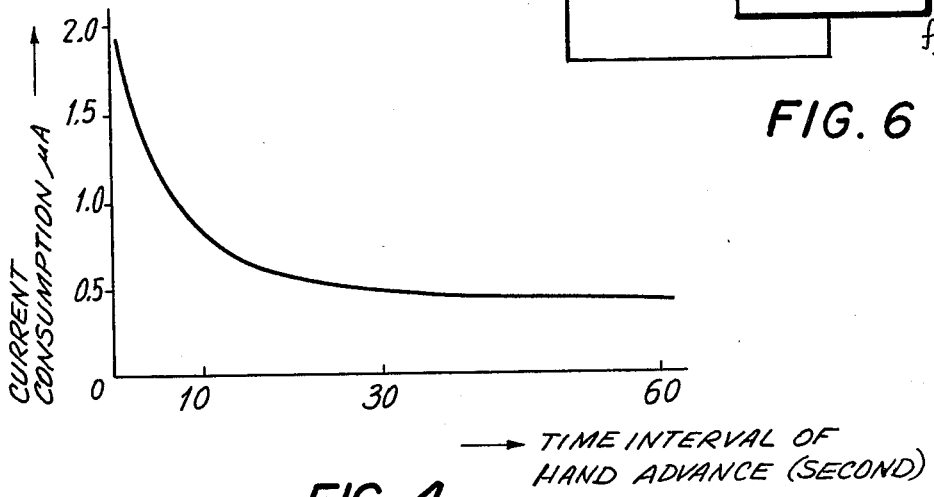
FIG. 4 is a graphical illustration of the relationship of the current consumption of an electronic wristwatch to the time interval over which the clock hands are advanced.
Figure 5:
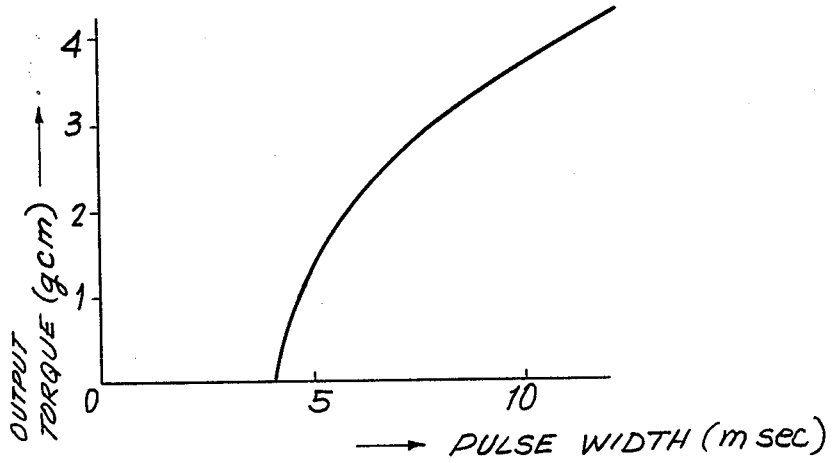
FIG. 5 is a graphical illustration of the relationship of the output torque of a step motor to the pulse width of the drive signal applied to the step motor.

The graphical illustration in FIG. 4 demonstrates the relationship between the period $T_1$ of the signal applied to the step motor and the power consumed by the step motor. Thus, if the period $T_1$ is ten seconds or greater, a dramatic reduction in the current consumption results. Additionally, as is illustrated is FIG. 5, the output torque of the step motor is related to the pulse width or duty cycle $t_1$ of the drive signal applied to the step motor. The values of torque, illustrated in FIG. 5, are for the rotational torque of the minute wheel in a conventional electronic wristwatch which is rotated at a speed that is decreased with respect to the speed of the rotor.

In light of the foregoing, it is apparent that the shorter the period $T_2$ of the intermediate frequency detection signal, the greater is the efficiency with which the timing rate of the divider circuit is measured. If a time period of one to ten seconds were selected for the intermediate frequency detection signal, although the current consumption of the detection circuit would be reduced, the time required to obtain a considerable accuracy of detecting the timing rate would be substantially increased. It is noted that the pulse width or duty cycle $t_2$ of the intermediate frequency detection signal is determined in accordance with the relationship between the performance of the detection circuit and the current consumption of the detection circuit. If the period of the detection signal is selected to be 1 ms to 2 ms, the intermediate frequency signal can be applied to the step motor since same will not be sufficient to permit rotation of the step motor and detection of the timing rate will be performed without a substantial drain of current. Moreover, the intermediate frequency detection signal can be provided with a fixed wave form in order to simplify the electronic circuit utilized to produce same. Also, if the intermediate frequency detection signal is applied to the step motor, the direction of the pulses can be selected so as not to drive the step motor in order to avoid rotation of the step motor if the period and duty cycle of the intermediate frequency driving signal are sufficiently large to effect rotation of the step motor.

Moreover, if a particularly small period intermediate frequency detection signal is selected, a timer circuit 15 can be provided for receiving the intermediate frequency detection signal $f_D$ so that the intermediate frequency detection signal is only produced for a specific period of time. After the specific period of time, the timer can automatically turn the rate detection circuit OFF or, alternatively, can return the selector circuit to a first mode so that the low frequency timekeeping signal $f_0$ is, once again, applied to the step motor. The use of a timer 15 would prevent the battery from being excessively drained when the timepiece is being stored or handled prior to the sale thereof.

Thus, the instant invention is particularly characterized by a control mechanism that permits the timekeeping circuitry to be turned ON or OFF and respectively produce either a low frequency timekeeping signal or an intermediate frequency detection signal, or, alternatively, a combination of ON and OFF modes whereby one or both type signals can be produced at the same time.

Moreover, the instant invention substantially reduces current consumption, and thereby permits the size of a battery to be reduced, hence permitting the electronic wristwatch to be further miniatured. It is noted that the embodiment detailed herein is directed to a low frequency timekeeping signal having a long period since the electronic wristwatch is without a second hand. It is noted, however, that the instant invention is equally applicable to electronic wristwatches that are capable of varying the period of the output signal since the rate detection feature of the instant invention readily permits adjustment of the timing rate of the timekeeping circuit.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic wristwatch including oscillator means for producing a time frequency time standard signal, divider means including a plurality of series-connected divider stages adapted to receive said high frequency time standard signal and in response thereto produce a low frequency timekeeping signal and at least one intermediate frequency signal, said intermediate frequency signal being used to detect the timing rate of the wristwatch and a step motor means adapted to be driven in response to said low frequency timekeeping signal being applied thereto, the improvement comprising selector means coupled to said divider means, said selector means normally being adapted to be disposed in a first mode for receiving and transmitting said low frequency timekeeping signal to said step motor means, said selector means being further adapted to be disposed into a second mode for receiving and transmitting said intermediate frequency signal, and a manually operative member adapted to be displaced between a first non-engaged position wherein the step motor means is driven and a second engaged position wherein said step motor avoids being driven, said manually operative member being operably coupled to said selector means when said manually operative member is disposed in said second engaged position to thereby dispose said selector means into said second mode.

2. An electronic wristwatch as claimed in claim 1, wherein said selector means including a manually displaceable selecting spring and a selector circuit, said selecting spring being disposed into an open engaged position in response to being engaged by said manually operative member when same is in said second engaging position, said said selecting spring being disposed in a closed position when said manually operative member is disposed in a non-engaging position, said selector circuit being disposed in a first mode for transmitting said low frequency timekeeping signal to said step motor means when said selector spring is in said open position and in a second mode wherein said intermediate frequency signal is not applied to said step motor means when said selector spring is displaced into said closed position.

3. An electronic wristwatch as claimed in claim 2, wherein said intermediate frequency signal is a detection signal representative of the timing rate of said divider means.

4. An electronic wristwatch as claimed in claim 3, wherein the period of said intermediate frequency signal is on the order of 2 ms, and the period of said low frequency timekeeping signal is at least one second.

5. An electronic wristwatch as claimed in claim 2, wherein said selecting spring includes a stopper portion adapted to be engaged by said manually operative member and a moving contact portion, said selector circuit including a fixed contact pin, said fixed contact pin being engaged by said moving contact portion of said selecting spring when said manually operative member is displaced into a non-engaging position.

6. An electronic wristwatch as claimed in claim 3, wherein said low frequency timekeeping signal has a period of at least ten seconds.

7. An electronic wristwatch as claimed in claim 6, wherein said intermediate frequency signal has a period of less than ten seconds.

* * * * *